US007666052B2

(12) United States Patent
Pierson

(10) Patent No.: US 7,666,052 B2
(45) Date of Patent: Feb. 23, 2010

(54) VARIABLE-HEAT SMOKE UNIT FOR MODEL VEHICLE

(75) Inventor: Martin Pierson, Howell, MI (US)

(73) Assignee: Lionel L.L.C., Chesterfield, MI (US)

( * ) Notice: Subject to any disclaimer, the term of this patent is extended or adjusted under 35 U.S.C. 154(b) by 1081 days.

(21) Appl. No.: 11/093,892

(22) Filed: Mar. 29, 2005

(65) Prior Publication Data

US 2005/0227575 A1 Oct. 13, 2005

Related U.S. Application Data

(63) Continuation-in-part of application No. 10/696,530, filed on Oct. 29, 2003, now Pat. No. 7,125,309, which is a continuation-in-part of application No. 09/968,959, filed on Oct. 1, 2001, now Pat. No. 6,676,473.

(51) Int. Cl.
*A63H 19/14* (2006.01)

(52) U.S. Cl. ..... 446/25; 446/484

(58) Field of Classification Search ..... 446/24–25, 446/484; 105/1.5; 472/52, 65; 392/401, 392/403, 396; 104/51–52, 307; 246/1 R, 246/167 R, 190–191, 193, 167 A, 187 A, 246/187 R See application file for complete search history.

(56) References Cited

U.S. PATENT DOCUMENTS 3,665,681 A 5/1972 Vitenko
3,891,826 A 6/1975 Seuthe et al.
4,198,992 A 4/1980 Smith
4,332,101 A 6/1982 Tomita
4,374,038 A 2/1983 Tamura
4,741,717 A 5/1988 Wolf
4,871,115 A 10/1989 Hessey
5,069,230 A 12/1991 Green
5,205,771 A 4/1993 Sims
5,312,281 A 5/1994 Takahashi et al.
5,334,071 A 8/1994 Mills
5,512,001 A 4/1996 Kent et al.
5,610,359 A 3/1997 Spector et al.
5,870,524 A 2/1999 Swiatosz
5,896,017 A 4/1999 Severson et al.
5,944,502 A 8/1999 Denchfield
6,019,289 A 2/2000 Sung
6,106,356 A 8/2000 Trageser
6,280,278 B1 8/2001 Wells
6,281,606 B1 8/2001 Westlake
6,457,681 B1 * 10/2002 Wolf et al. ..... 246/187 A
6,485,347 B1 11/2002 Grubba et al.

(Continued)

*Primary Examiner*—Peter DungBa Vo
*Assistant Examiner*—Alex F. R. P. Rada, II
(74) *Attorney, Agent, or Firm*—O'Melveny & Myers LLP

(57) ABSTRACT

A smoke generating unit for a model vehicle controls and varies the rate at which smoke is generated by controlling power to a heater. The model vehicle is electrically driven, and the smoke-generating unit is configured to emit smoke so as to mimic varying emission from a traditionally-fueled vehicle, such as a steam-driven or diesel-driven vehicle. Smoke is generated in proportion to power supplied to the heater. A controller controls the power as a function of various control inputs, such as vehicle engine load, vehicle speed, or user input. Temperature or power feedback may be used as input for a closed-loop control process. A blower for the fan may be controlled via an analog circuit in response to velocity or load input to simulate a steam or diesel locomotive.

38 Claims, 6 Drawing Sheets

U.S. PATENT DOCUMENTS 6,619,594 B2 9/2003 Wolf et al.
6,624,537 B2 9/2003 Westlake
6,655,640 B2 12/2003 Wolf et al.
6,676,473 B2 1/2004 Pierson et al.

* cited by examiner

VARIABLE-HEAT SMOKE UNIT FOR MODEL VEHICLE

RELATED APPLICATION DATA

This application is a continuation-in-part of U.S. application Ser. No. 10/696,530, filed Oct. 29, 2003 now U.S. Pat. No. 7,125,309 , which is a continuation of U.S. application Ser. No. 09/968,959, filed Oct. 1, 2001, now U.S. Pat. No. 6,676,473. Both of the foregoing applications are hereby incorporated by reference, in their entirety.

BACKGROUND OF THE INVENTION

1. Field of the Invention

The invention relates to accessories for model vehicles, and, more specifically, to a smoke generating device for a model train or other model vehicle.

2. Description of Related Art

Model train engines having smoke generating devices are well known. Some smoke generating devices generate smoke at a substantially constant rate. More sophisticated smoke units may produce smoke at a rate proportional to the speed of the train, or to the loading of the engine of the train. Notwithstanding the advantages of such units, they may be subject to certain disadvantages. Some such units employ a resistive heating element to heat an oil or other smoke generating material. When the smoke unit is operated for a long period of time, or at high output levels, the heat generated by a resistive element may cause the smoke generator to fail, or may pose a safety hazard if not properly controlled.

In addition, some smoke generating devices depend on maintenance of a constant voltage across the heating element of the smoke generating unit to maintain a desired smoke output rate. Power is usually supplied from the model train track, but track voltages may be subject to considerable fluctuations. Therefore, maintaining adequate control over power supplied to the heating element of the smoke generating device may not be possible, or may require expensive electronic controls. Temperature fluctuation may occur in response to fluctuations in voltage supplied to the heating element of the smoke generating unit. When the temperature fluctuates, the smoke output rate may vary. Therefore, smoke output from the smoke generating unit may differ from what is intended or desired.

It is desirable, therefore, to provide an improved smoke generating unit for a model train, that more effectively controls smoke output and reduces the risk of overheating, without adding undue cost or complexity.

SUMMARY OF THE INVENTION

The present invention provides a smoke or visible vapor generator for a model vehicle, that overcomes the limitations of the prior art. The smoke or visible vapor generator of the present invention may comprise a controller, a heater in electrical communication with the controller, and a temperature sensor or an indicator of power supplied to the heater in electrical communication with the controller. In an embodiment of the invention, a temperature sensor may be disposed proximate the smoke generating element, and configured to sense a current temperature of the smoke generating element. In the alternative, the controller may be configured to control power supplied to the heater, in which a correlation exists between heater power and temperature of the smoke generator or its rate of smoke output. In the first case, the controller receives a signal indicative of a temperature of the smoke generating element. In the second, a power feedback signal may provided to the controller, or the control may be accomplished without feedback (i.e., open loop).

The controller may be configured to control power supplied to the heater based on a measured temperature of the smoke unit or power supplied to the heater, and a corresponding temperature or heater power set point. The set point may be fixed or variable. In an embodiment of the invention, the set point varies in relation (either linearly or non-linearly) to a measured engine load of the model train.

In addition, the controller may provide for a reduction in power to the heater when the temperature of the heater reaches a temperature limit threshold level. The threshold level may be selected to as to permit maximum smoke output while preventing heat damage to the smoke unit. Generally, this upper limit on temperature should be constant for a given smoke unit design.

In an embodiment of the invention, a user interface may be provided to permit a degree of user control over the quantity of smoke generated at a given vehicle velocity or engine load. For example, users may desire more smoke to be generated while operating outdoors or in a well-ventilated space, than in less well-ventilated spaces. A user interface may be provided that allows a model train user to select a desired smoke quantity level, e.g., low, medium, or high. The user-selected smoke level may then be applied as a multiplier, factor, or offset across all engine loads. Thus, the smoke unit may be caused to provide a variable output in proportion to engine load, with user control of a general smoke output. Likewise, the user interface may be used to permit selection of an absolute smoke output, if desired, which may be applied irrespective of vehicle velocity or engine load.

The controller may determine a control output for controlling the smoke output at any point in time, using any suitable control scheme as known in the art. For example, a proportional-derivative-integral (PID) control method may be applied to maintain the smoke unit temperature, using power supplied to the heating element of the smoke unit as the control output and temperature as measured by a sensor in the smoke unit as a control input. In the alternative, power supplied to the heater may be controlled to be equal to a power set point, wherein the power set point corresponds to an expected heater temperature. Feedback may then comprise a measurement of voltage, current, or power supplied to the heater.

The temperature or power set point may vary with time, and may be determined by the controller as a function of input power to the engine, train speed, a user-determined scale factor, or any other desired parameter. For example, the controller may receive an engine load factor and user-determined smoke control factor as inputs, and calculate a corresponding set point using a linear or non-linear function, or a look-up table. The set point may then be provided to the controller, which maintains operation of the unit at the set point until the set point is changed.

Fan control for the smoke generator may be accomplished separately. For example, an analog control circuit may be provided to operate the fan in coordination with wheel movement, for a model of a steam locomotive. Likewise, an analog circuit may be provided to modulate fan speed in coordination with engine load or train velocity, for a model of a diesel locomotive. In the alternative, fan control may be accomplished using a digital controller as known in the art.

A more complete understanding of the temperature-controlled smoke unit for a model train will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
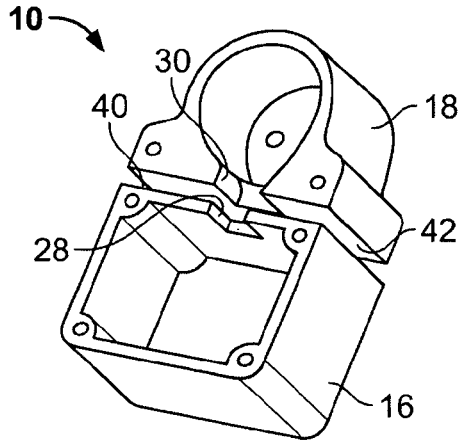
FIG. 1 is an isometric view of a housing for a smoke generating unit according to an embodiment of the present invention.

The present invention provides a smoke or visible vapor generator for a model train, that overcomes the limitations of the prior art. In the detailed description that follows, like element numerals will be used to indicate like elements appearing in one or more of the figures. For convenience, as used herein the term "smoke generator" should generally be understood to encompass a generator for either of, or both of, visible vapor and smoke.

A smoke generator according to the invention may comprise a heater functioning as smoke generating element, a controller configured to control power supplied to the heater, a tank or other container for fuel, and a temperature sensor providing temperature feedback to the controller. In the alternative, the temperature sensor may be omitted, and the controller may control the heater power based on a power set point that correlates to an expected heater temperature or smoke output, or using open-loop control without feedback. The fuel may be exposed to heat from the heating element inside of a smoke-generation chamber. The heater raises the temperature of the fuel to a temperature less than its ignition point, but sufficiently high to cause vaporization or pyrolysis of the fuel, which therefore begins to smoke or to emit visible vapor. For example, an oily petroleum fuel may undergo vaporization or pyrolysis at a temperature below its ignition point, creating visible vapor or smoke without a flame. The heater may comprise a resistive heating element, for example, a nickel chromium wire.

In general, it is believed that for many smoke generator designs and typical fuel materials, the rate at which visible vapor or smoke is generated increases with increasing temperature of the heating unit. The temperature of the heating unit, in turn, may be correlated to power consumed by a heating element. The relationship between smoke rate and temperature or power of the heating unit may be approximately linear within a limited temperature range. The amount of smoke generated at a given temperature or power level may vary, however, depending on the design of the smoke generator and the type of smoke-generating fuel used. For a given configuration of smoke generator, one of ordinary skill may readily determine a useful range of temperatures or power levels that correlate to smoke output in a predictable fashion. The range may be bounded by an maximum upper threshold temperature or power, below which the generator may be operated safely and reliably, without ignition, heat damage, safety hazards, or undue heat fatigue. A lower bound may be provided by a minimum temperature or heater power below which the fuel will not emit a visible quantity of smoke. In the alternative, any other desired endpoint may be selected for a lower bound. In between these endpoints, the generator design and fuel selected should be such that the rate of visible smoke or vapor output is a continuous and reversible function of the temperature of the smoke generator or of power supplied to the heater.

Thus, the controller may be configured to control an amount of power supplied to the smoke generating heater to control a rate of visible vapor or smoke emitted from the model train. For example, power supplied to the heater may be controlled by pulse width modulation, voltage modulation, or otherwise, using input from the temperature sensor in a feedback control loop. The heater may be driven so as to drive the temperature input to a temperature set point, resulting in a stable rate of smoke generation. When it is desired to increase or decrease the amount of smoke generated, the controller may adjust the temperature set point upwards or downwards, to the limits of the working temperature range of the smoke generator unit.

In the alternative, the temperature sensor may be omitted and the controller may modulate power according to a power set point. The power set point may be selected to correlate with an expected temperature of the smoke generating unit, smoke density, or rate of smoke output. For example, the controller may modulate power supplied to the heater to a specified power limit. For example, pulse width modulation or voltage-control oscillation may be used for power control.

The controller may receive input corresponding to a load on the model train and adjust the desired temperature or power set point accordingly. The load on the model train may correspond to a voltage across an engine of the model train or the speed of the model train. In the alternative, or in addition, the controller may adjust the temperature or power set point based on user input. For example, a user may indicate via a user interface that a general level of smoke output, such as "low," "medium," or "high," is desired. In response, the controller may scale the temperature or power set point accordingly while still varying the set point based on engine load, or maintain a constant set point, depending on the desired effect.

Optionally, the smoke generator may comprise a fan operably connected to the controller. The controller, or a separate control circuit, may be configured to control the angular velocity of the fan, thereby controlling a velocity at which smoke is emitted from the model train. For example, it may be desired to emit smoke in puffs, and so the fan may be controlled to as to cause a puffing effect. In addition, or in the alternative, it may be desired to expel the smoke from the generating unit at a speed proportional to engine load.

Using the fan to control airspeed through the smoke generating unit may also affect the quantity at which smoke is generated. It may therefore also be desirable to automatically adjust the temperature or power set point so as to compensate for the effect caused by the fan. For example, if it is found that an increase in fan velocity causes an increase in smoke rate, the set point may be lowered as air speed is increased. The converse—a decrease in smoke rate with increase in air speed—may also occur, depending on the design of the smoke unit, and may similarly be compensated for by adjusting the controller set point.

Figure 4:
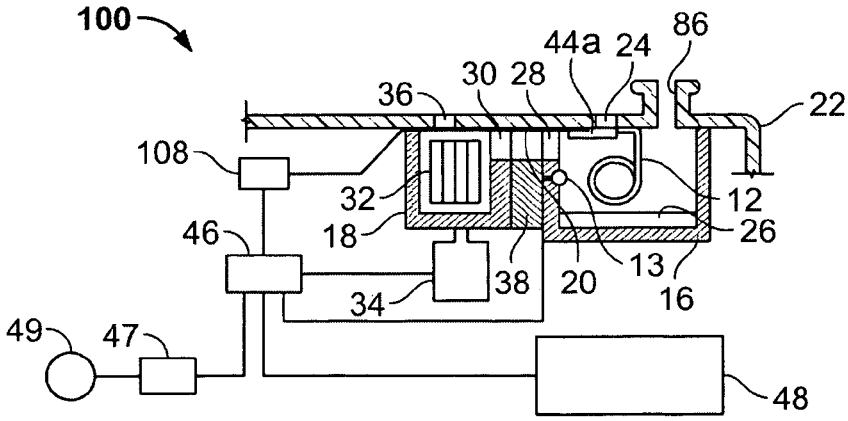
FIG. 4 is a combined block diagram and cross sectional view of a smoke generating unit mounted to a model train, according to an embodiment of the invention.

Referring now to FIGS. 1 and 4, an exemplary design for a smoke generating unit 100 according to the invention may comprise a housing 10, a heater 12 and a blower 32 for emitting smoke from a model train 22. The housing 10 may comprise a first sub-housing 16 and a second sub-housing 18. First sub-housing 16 may be mounted to an interior surface 20 of the model train model train 22 and used to hold oil or other suitable fuel for smoke generating. Fuel may be added through an aperture 24 of model train 22. A second opening 86 may serve as a smoke outlet during operation. In the illustrated embodiment, the smoke outlet 86 is shaped like the smoke stack of a model train. While an oil burning smoke element is shown, the invention can be practiced with any type of smoke generator and any type of heat-driven smoke generating process known in the art.

A suitable temperature sensor 13 may be provided so as to sense a temperature in the smoke generating chamber inside housing 16. Sensor 13 may be connected to provide temperature feedback to a controller 46. Sensor 13 may comprise any suitable sensing element, for example, a J-type thermocouple, a K-type thermocouple, or a thermistor. The temperature sensor may be mounted in any suitable location, for example, in the interior of housing 16 across or adjacent to heater 12, as shown. In this position, the sensor may receive thermal radiation directly from heater 12. In the alternative, the sensor may be mounted on an exterior of housing 16, in thermal conductive contact with heater 12. Other locations may also be suitable. In general, sensor 13 should be disposed so as to provide a prompt and proportional reaction to both upward and downward changes in the controlling smoke-generating temperature. This controlling temperature may generally be closer to that of the smoke generation chamber as a whole, i.e., of the interior of housing 16, than that of the heater itself, as should be the case in the depicted embodiment.

In other embodiments, however, such as when the heater directly contacts the fuel via a wick or other transport device, the controlling temperature may be that of the heater itself. Certain designs may be more suitable for control systems that do not incorporate a temperature sensor. For example, a design wherein the fuel directly contacts the heater element may be configured such that the rate of smoke output directly correlates to power supplied to the heating element. Thus, designs of this type may be more readily controlled without a temperature sensor. One of ordinary skill may thus select a suitable location for the sensor, or a sensor-less mode of control, based on the configuration of the smoke-generating unit.

First sub-housing 16 may be any suitable geometric shape, such as generally rectangular, circular or irregularly shaped. Housing 16 should admit the mounting of a heater 12 in the interior of the housing, away from contact with the fuel reservoir. In the alternative, the fuel may be directed to the heater using one or more suitable wicks or other transport device. A design in which the heater is submerged in fuel may also be possible.

First sub-housing 16 may also comprise an opening 28. Opening 28 of first sub-housing 16 may be aligned with an opening 30 of second sub-housing 18. Openings 28 and 30 place the first and second sub-housings 16 and 18 in fluid communication with each other. Openings 28 and 30 are shown in FIGS. 1 and 4 as generally rectangular in cross-section. However, the openings 28 and 30 may be of any geometric configuration. While the first and second sub-housings 16 and 18 are shown positioned adjacent to each other, the invention may be practiced with first and second sub-housings positioned apart from each other. A conduit may be positioned between the first and second sub-housings 16 and 18 to place the first and second sub-housings 16 and 18 in fluid communication with each other. In the alternative, any other number of sub-housings, including a single sub-housing, may be used, or housing 18 may be omitted altogether.

If present, second sub-housing 18 may be shaped to correspond to the shape of fan 32. For example, the second sub-housing 18 may be cylindrical in shape to correspond to a squirrel cage fan 32 as depicted in the illustrated embodiment. On the other hand, it is not necessary that the second sub-housing 18 be shaped to correspond to the shape of fan 32. For example, second sub-housing 18 may be rectangular prism-shaped and house a squirrel cage fan 32. Housing 18 may also be omitted, even if a fan is provided.

Housing 10 contains the smoke-generating fuel and the heater 12, and optionally houses a blower. Housing 10 may be fabricated from any material having sufficient rigidity and thermal resistance. For example, housing 10 may be fabricated from aluminum, steel, cast iron, high-temperature plastic, or an appropriate alloy. One suitable material for the housing 10 may comprise an alloy having the trade name "Zamak 3." Zamak is a well known alloy of zinc, copper, aluminum and magnesium. In addition, in an embodiment of the invention including first and second sub-housings 16 and 18, the first and second sub-housings 16 and 18 can be fabricated or formed from different materials.

Figure 2:
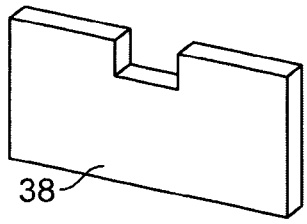
FIG. 2 is an isometric view of an insulating gasket for sealing a smoke generating unit according to an embodiment of the invention.

Referring now to FIG. 2, the present invention may also include an insulating gasket 38. Gasket 38 may be interposed between housings 16 and 18 to thermally insulate the second sub-housing 18 from the first sub-housing 16, if desired. Gasket 38 may comprise any suitable material, for example, silicone rubber rated to 500° F.

Figure 3A:
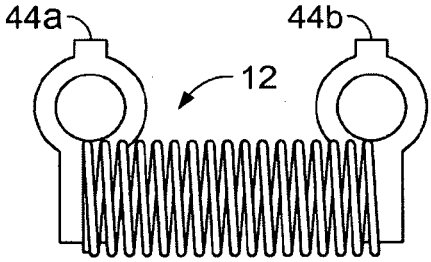
FIG. 3A is a front view of a heater of a smoke generating unit according to an embodiment of the invention.
Figure 3B:
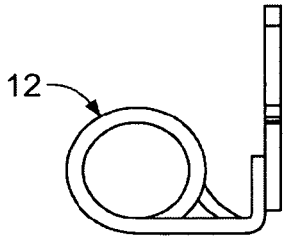
FIG. 3B is a side view of the heater shown in FIG. 3A.

Referring now to FIGS. 3A and 3B, heater 12 may comprise any suitable resistive or radiation heater, for example a nickel-chromium wire. Heater 12 may be provided with suitable terminals for making a power connection, for example, ringlet terminals 44*a* and 44*b* at opposite ends of the heater 12. The terminals 44*a* and 44*b* can be integral with the nickel chromium wire of the heater 12 or can be crimped on the heater 12. Heater 12 can be engaged with interior surface 20 by rivets or screws or any other suitable fastener that can withstand the thermal energy emitted by the heater 12. As shown in FIG. 4, the heater 12 may be mounted to interior surface 20 of model train 22 and extend downwardly into first sub-housing 16. A great variety of different heater configurations may be utilized as is generally known in the art. For greater control, the capacity of the heater, i.e., its heat output, should be selected to permit rapid heat adjustment without excessive overshoot or excessive power draw.

If the heater 12 is not maintained at a controlled heat output, then the quantity of smoke may vary in an unintended fashion. For example, smoke output may vary with fluctuations in the power supply, with external temperature, or other variables. Thus, power to the heater should be controlled via a power controller 108 controlled by controller 46, as described in more detail later in the specification. In an embodiment of the invention, the heater power is controlled based on feedback from the temperature sensor 13. In this embodiment, the smoke generating unit maintains the temperature of the interior of housing 16 (or other operable smoke-generating device) with a temperature sensor, allowing for precise control of generator temperature and smoke output. In an alternative embodiment, power is controlled using voltage or current modulation to a defined power set point. Temperature or power set points may be varied to achieve a desired smoke output, according to a relationship between temperature and smoke output, or between heater power and smoke output, that is characteristic of any particular smoke generator design. The invention is not limited to designs of this type, however.

For example, in an alternative embodiment, smoke output may be varied by supplying a varying amount of fuel to a heater, which therefore needs not be controlled except to hold at constant power. In such a design, fuel flow may be controlled by various methods, such as by adjusting a fuel valve, baffle, or fuel pump speed. Such designs may be more complex than heater control, but should be considered within the scope of the invention. To implement this embodiment, heater control as disclosed herein may be modified to control a rate of fuel flow to the heater by controlling power to a fuel pump, valve, or other flow control device. One of ordinary skill should be able to readily accomplish such adaptations based on the disclosures herein.

Referring now to FIG. 4, first sub-housing 16 may comprise a lamina 26. Lamina 26 may comprise a thin plate, scale or layer made of fibrous material to absorb the oil directed into first sub-housing 16 through aperture 24. Lamina 26 may absorb and retain oil to be heated by the heater 12. Lamina 26 should be operable to withstand the maximum thermal energy generated by the heater 12.

If present, second sub-housing 18 may be mounted to an interior surface 20 of model train 22 and house a fan 32 of blower 14 for directing an air stream through the housing 10. Fan 32 may comprise any suitable fan, for example a squirrel cage fan, an axial fan, a radial flow fan, a mixed flow fan or a cross-flow fan. Fan 32 may be positioned inside the second sub-housing 18. A motor 34 for rotating the fan 32 may be positioned outside to the second sub-housing 18. Rotation of fan 32 should draw the air stream through an aperture 36 of model train 22. The air stream should be directed through openings 30 and 28 into first sub-housing 16. Other configurations may also be suitable, and the invention is not limited by a particular blower configuration. Other elements 47, 48, 49 shown in FIG. 4 are further described below, in connection with FIG. 5.

Figure 5:
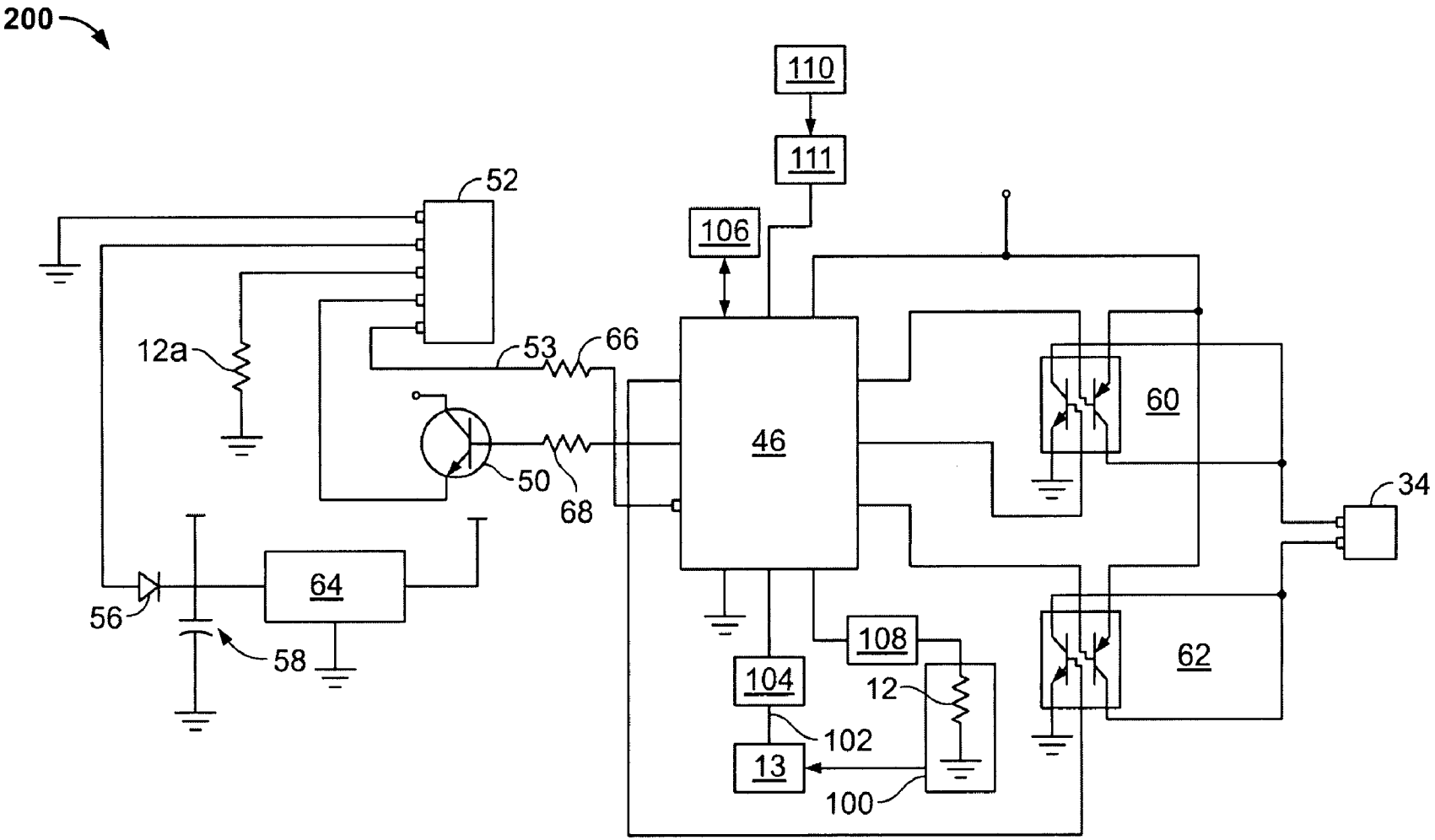
FIG. 5 is a circuit schematic for an exemplary smoke generating unit according to an embodiment of the invention.

Referring now to FIG. 5, a schematic circuit diagram is provided showing an exemplary electric circuit 200 according to the present invention. Controller 46 may comprise a micro-controller or microprocessor operable to receive input signals and emit output signals, for example, a PIC 12C508 chip. The controller 46 may be in communication with the engine of the train through a serial communication line 53 including the input connector 52. Serial communication line 53 may transmit a wide variety of information about a suitably configured model vehicle attached to connector 52. This information may comprise, for example, a velocity of a model train 22, engine load, and various commands addressed to the model train, including but not limited to commands to operate engines, doors, sound generators, and the like.

A protection resistor 66 may be provided on a communication line between the controller 46 and the input connector 52. The voltage across a main engine of the train may be communicated to the controller 46 via serial communication line 53. Based on a program stored in memory, the controller 46 may control the operation of the motor 34 to control an airstream generated by the fan. The controller 46 may thereby control a rate of the airstream through smoke generator 100.

The direction of the blower motor 34 may be controlled by alternating the voltage across the motor 34 with an H-bridge formed with a pair of chips 60 and 62. The chips 60 and 62 may comprise XN4316 chips and may be controlled by the controller 46. The velocity of the motor 34 may be controlled by changing the level of voltage supplied to the motor 34 with the controller 46. The circuit may also comprise a voltage stabilizer defined by diode 56, capacitor 58 and regulator 64. In the alternative, or in addition, circuit 200 may also comprise an element 50 for controlling a lamp, or relay, or other model vehicle device when a command is received. It should be appreciated that a plurality of elements similar to element 50 may be provided.

Smoke generating unit 100 may include a temperature sensor 13 that is operably connected to and in communication with controller 46. For example, sensor 13 may communicate through a serial communication line such as line 53, via a direct connection 102, or via a wireless connection. If present, temperature sensor 13 should be disposed to sense an operative temperature of heating unit 100, and to then produce a corresponding signal indicative of the sensed temperature. In an exemplary embodiment, a J-thermocouple may be used for the temperature sensor 13. Various thermistors, other types of thermocouples, bimetallic reeds, or any other temperature-responsive sensor may be used. The temperature sensor generates a signal having a defined relationship to an operable temperature of unit 100 to controller 46.

The signal generated by the temperature sensor may pass through a suitable signal conditioning device 104 before being supplied to processor 46. Various signal conditioners are known in the art, depending on the type of sensor used. For example, device 104 may comprise an amplifier, or a logic device.

Controller 46 may be configured to receive the temperature sensor input and other inputs to determine one or more control signals for controlling operation of the heater 12, fan motor 34, or other components. In an embodiment of the invention, the controller may be so configured by programming a memory of the controller with suitable program instructions. Controller 46 may, in the alternative, be implemented entirely in hardware. Whether operating using hardware and software, or hardware only, controller 46 may be configured to implement a feedback control scheme using power to heater 12 as the control input and the temperature input signal as control feedback. In the alternative, output power may be controlled using open-loop or closed-loop control without temperature feedback. As previously described, the smoke generator unit may be configured such that a rate of smoke output is related to the temperature as sensed by sensor 13, or to power supplied to the heater. Thus, the processor may effectively control smoke output rate by controlling power to heater 12 using feedback from sensor 13, or using open-loop control.

Various feedback control schemes, for example, proportional, proportional-integral, or proportional-integral-derivative, are known in the art, and may be implemented using processor 46 to control the heater such that the temperature input from sensor 13 is driven towards a temperature set point. Power to the heater may be controlled, for example, via a power controller 108. A given temperature set point (or power set point) and fan speed should therefore generally result in a given rate of smoke output. By maintaining a constant peak fan velocity in a "puffing" mode, variation in smoke output may be controlled by controlling power to the heater, while using fan control to control the time between puffs of smoke and the duration of each puff. In the alternative, when it is desired to vary fan velocity, controller 46 may be programmed to appropriately adjust the set point temperature to compensate for variation in smoke production caused by changes in the smoke generator airstream.

In most applications, varying of smoke output is desired. Accordingly, the temperature or power set point used in the heater control program may be varied, either manually by the user, automatically by the controller, or based on some combination of manual and automatic input. For example, the set point may be automatically increased when controller 46 receives a signal indicating that engine load has increased, thereby increasing smoke output to simulate a more heavily-loaded steam or diesel engine. Likewise, the set point may be decreased when the engine load decreases. Vehicle speed or other input may also be used as a basis for heater control. Such inputs may be received automatically or via user inputs. In addition, a user may desire to set overall operating conditions such as high, medium, or low smoke output. Such user input may be used as a factor in determining a range of temperature or power set points along with automatic input parameters.

Power supply 106 may provide power to controller 46, as well as to the motor H-bridge formed with chips 60, 62. The voltage sent to the heating element 12 may be adjusted through the use of a power controller 108 disposed between the controller 46 and the heating element 12. Power controller 108 may comprise, for example, a triac, a BJT (bipolar junction transistor), a FET (field effect transistor), or a MOSFET (metal oxide semiconductor field effect transistor). It should be noted that while only the above referenced power controllers are named, they are provided for exemplary purposes only and are not limiting in nature. Those skilled in the art will recognize that other power controllers exist that remain within the spirit and scope of this invention.

The power controller 108 may use any suitable method to adjust power supplied to the heating element 12. For example, pulse width modulation (PWM) or voltage-control oscillation may be used to vary power applied to heating element 12. In the alternative, controller 108 may vary a voltage or current applied across terminals of heater 12, in response to a control input from controller 46. The power controller 108 may also use an ON/OFF technique to reduce power to the heating element 12. Other power control techniques may also be suitable.

Circuit 200 may also include a feature that provides for the automatic shut-off or reduction in power to the heating element 12 if the temperature of the heating element 12is at or above a defined maximum threshold temperature. For example, controller 46 may be programmed to prevent any temperature or power set point from exceeding a defined maximum threshold. That is, for further example, any temperature or power set point exceeding the threshold may merely be equated to the maximum threshold temperature or a maximum power threshold, respectively. The maximum temperature or power threshold may be selected to prevent occurrence of undue safety hazards, risk of damage to the smoke generator, excessive smoke output, or long-term fatigue from excessively high temperatures. In the alternative, or in addition, a separate control device (not shown) may be triggered. For example, a thermostatic switch or fuse as known in the art may switch off all power to the heater if a maximum threshold temperature is exceeded. Such a separate device may operate essentially as a fail-safe device in the event that processor 46 fails to accurately control the operating temperature of the smoke generation unit. The threshold temperature of a fail-safe device should be sufficiently higher than a threshold for processor 46, so as to prevent inadvertently triggering the fail-safe device.

In an exemplary embodiment, the smoke generating unit also comprises a user interface 110. User interface 110 may allow for the selection of a desired level of smoke production, and may comprise, for example, a keypad or remote control. A remote interface 110 may communicate wirelessly with a receiver 111 operably associated with controller 46. For example, the user may select a high, medium, or low smoke quantity level. Each selected level may correspond to a particular temperature set point, e.g., 200° C., 300° C., or 500° C. in a memory of the controller 46. This may permit a user of a model train to select a desired quantity of smoke regardless of the current operation of the model train engine. For example, although a model train engine may be moving slowly with a light load, a user may desire a high smoke quantity. In the alternative, a model train engine may be moving quickly with a heavy load, while a user may desire a low smoke quantity. The power controller 108 will adjust the amount of voltage applied to the heating element 12 and will thereby adjust the temperature of the heating element 12 so as to control the quantity of smoke emitted from the smoke generator.

In the alternative, or in addition, a user may desire to generally decrease or increase smoke output by some factor, while still observing a smoke output that is proportional to engine load or speed. Accordingly, each smoke quantity level may correspond to a temperature multiplication factor in a memory of controller 46. For example, "low" may correspond to 50%, "medium" to 75%, and "high" to 100% of maximum possible smoke output. The controller 46 may adjust the temperature or power set point by an amount indicated by the user input factor to effectively scale the range of temperatures available in the smoke generation unit upwards or downwards, while otherwise applying automatic control based on engine load, speed, or other control parameter. For example, if a normal range is between 225° C. and 525° C., applying a factor of 50 % would shrink the range to between 225° C. and 375° C. (where 375=½(525−225)+225). The lower endpoint of the range is not shifted in this example, but may be lowered if desired. It should be appreciated that the foregoing examples are by way of example, and not by way of limitation. Other smoke quantity levels that are more precise, for example, may be defined, or other methods of combining user input and automatic input may be used within the spirit and scope of the invention.

Figure 6:
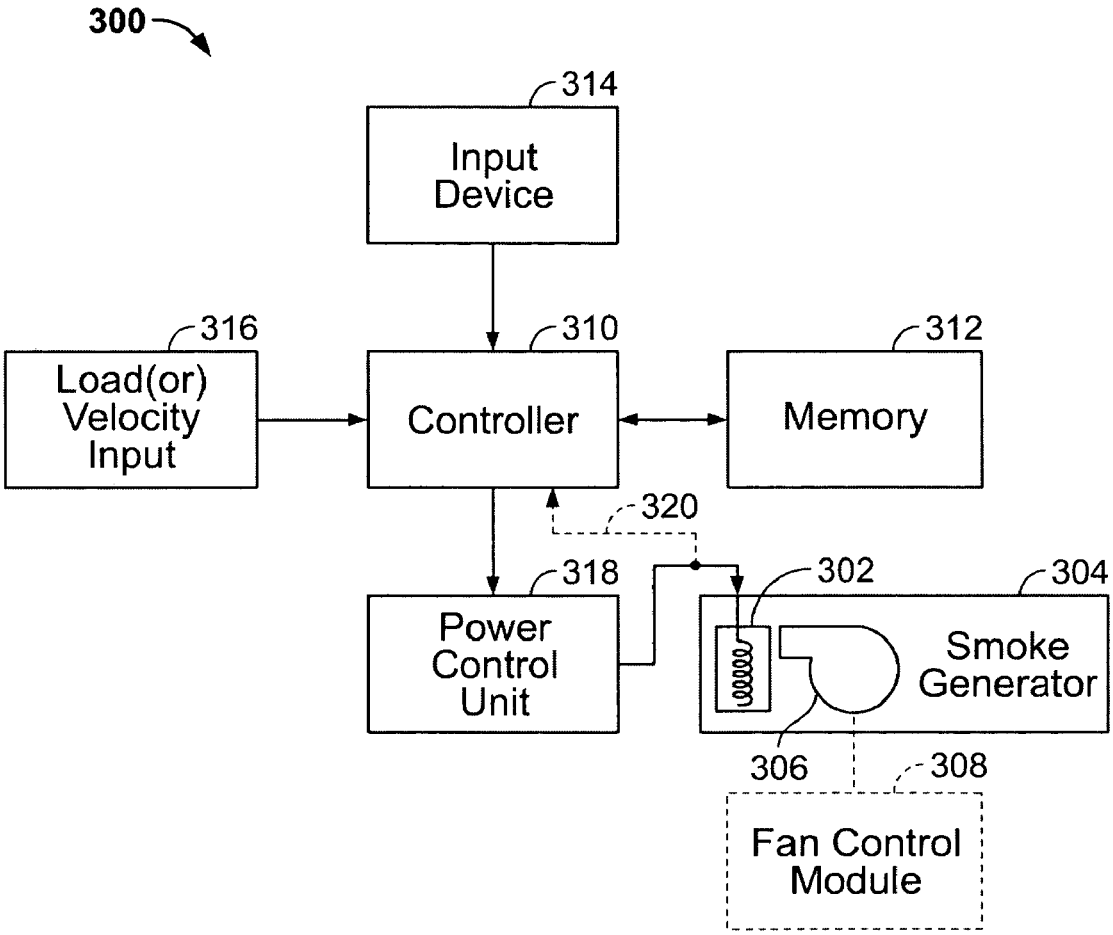
FIG. 6 is a block diagram for an exemplary smoke generating unit, according to an alternative embodiment of the invention.

Although temperature feedback using a temperature sensor is believed to provide more accurate control of heat and smoke, sufficient control may be achieved in a system that omits the temperature sensor. Advantageously, omitting the temperature sensor should provide some cost savings. FIG. 6 shows a system 300 for controlling heater 302 power without using temperature feedback. Smoke generator 304 may comprise a heater 302 and blower 306 as previously described. Blower 306 may be controlled using any suitable fan control module 308, such as described herein or in the parent applications.

System 300 comprises any suitable programmable logic controller, for example, an R2LC controller as available from Lionel L.L.C. Controller 310 may be operably associated with a memory holding program instructions and variables, such as a power set point, for use in a control method. The controller may further be operably associated with a user input device 314, such as a panel, keyboard, or remote control unit, from which user input may be received. User input may comprise a control signal indicating a desired level of smoke output. Controller 310 may further be connected to an input indicating a train velocity or engine load. Various suitable sensors and associated hardware for providing such inputs are known in the art.

Controller 310 may be programmed to generate a control signal by applying a selected or predetermined function using a load or velocity input. Optionally, the function may also incorporate user input. For example, controller 310 may determine a time integral of a velocity signal, and apply a linear scale factor determined from user input to provide an output control signal indicative of a desired level of power to be supplied to heater 302. Non-linear functions may also be applied to determine a control signal, for example, exponential or logarithmic functions, bell functions, post-office functions, etc. The control signal may be provided to a power control unit 318, which provides a controlled amount of power to heater 302, depending on the value of the control signal. In effect, the control signal from controller 310 defines a power set point for heater 302. Power to heater 302 may be controlled in any suitable manner, for example, pulse width modulation, voltage control, etc., as herein described.

Optionally, system 300 may comprise a feedback loop 320, providing an indicator of heater power to controller 310. Controller 310 may then adjust the control signal to the power control unit using any suitable control method, e.g., PID control, to provide a more accurate power level to the heater. This may be desirable, for example, if the power control unit is supplied by track voltage, which may fluctuate considerably in response to changes in track loading. In such cases, the feedback loop may be helpful for maintaining a stable and accurate power level to the heater 302. In the alternative, the feedback loop 320 may be omitted. This may be desirable if the power control unit is able to provide accurate and stable power to heater 302 under normal operating conditions, such as if the supply voltage is stable. In the alternative, a power control unit may be selected that incorporates an internal feedback control system for maintaining a stable power output.

Figure 7:
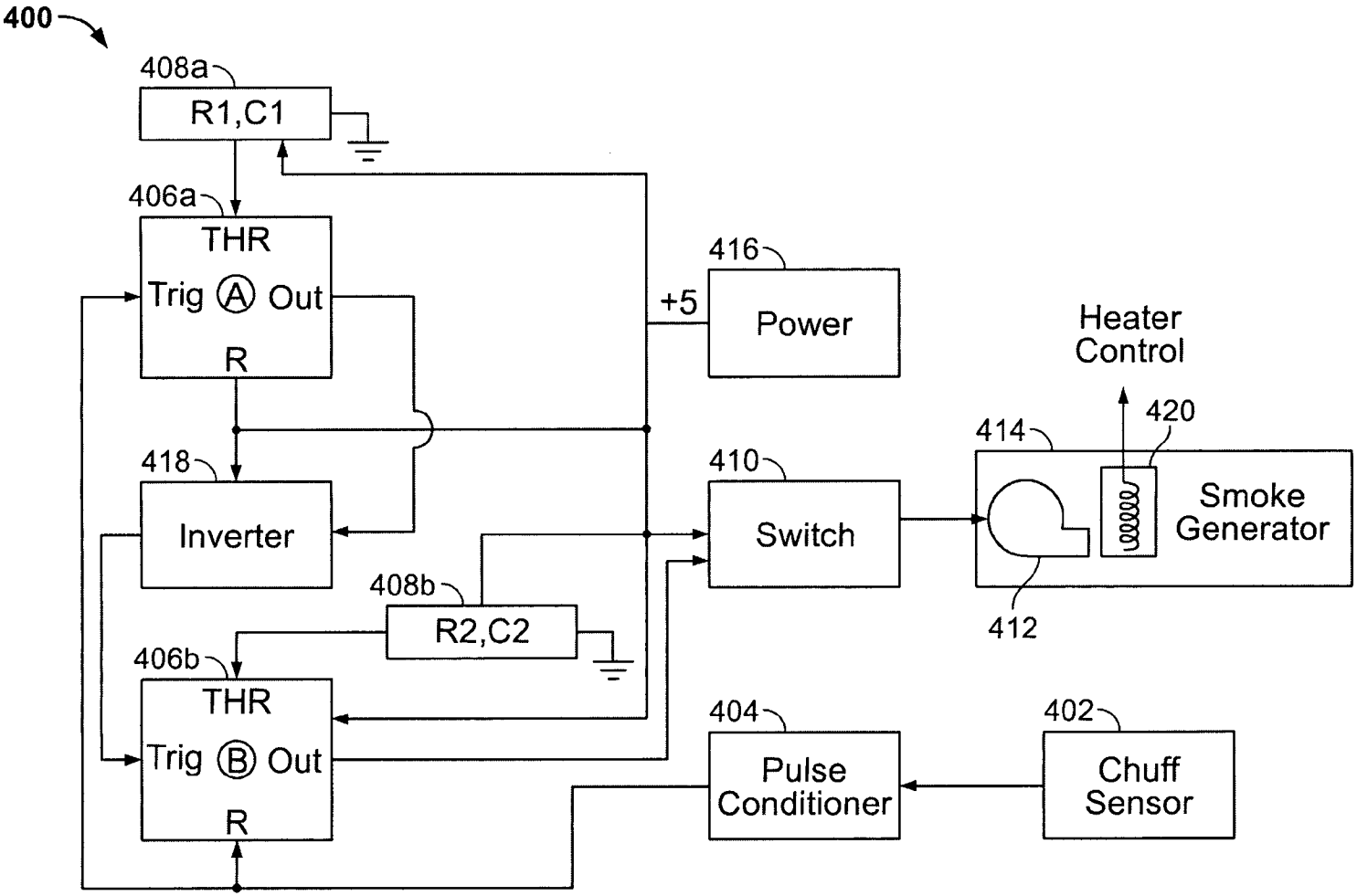
FIG. 7 is a block diagram for an analog control circuit for fan control to simulate a steam engine.

As previously described, fan or blower control may be combined with heater control, or used independently of heater control, to simulate smoke generated by steam of diesel locomotives. In an embodiment of the invention, an analog control circuit is provided to provide "chuff" control for a blower, in response to a chuff sensor or velocity sensor. FIG. 7 shows one such exemplary analog control circuit 400. Chuff sensor 402 may comprise a Hall Effect sensor, Cherry switch or other mechanical position switch, encoder, photodetector, or any other sensor for sensing movement of the vehicle wheels or of the vehicle itself. In an embodiment of the invention, the chuff sensor generates a square wave (e.g., short to open, or $+V_{cc}$ to ground transition) synchronized to wheel movement. For example, 1, 2, 3, 4 or any other number of pulses may be generated for each rotation of a model locomotive drive wheel.

In an embodiment of the invention, the signal from chuff sensor 402 may be provided as input to a signal conditioning module 404. The signal conditioning module may operate to filter voltage spikes or noise, correct any troublesome DC offset, adjust the signal gain or the waveform, or otherwise condition the signal for use in timing operation of the fan motor. The desired signal conditioning will depend on the nature of the downstream control circuit. In the depicted embodiment, the chuff signal is used to trigger and reset cooperating NE555 analog timers. Accordingly, module 404 may be configured as a signal differentiator or differentiator/rectifier. Given a square wave as input, a differentiator or differentiator/rectifier provides very brief pulses coinciding with the rising and falling edges of the square wave. These pulses may be of opposite polarity, or may be rectified to be of the same polarity. The output pulse width is determined by the duration of the rising and falling edges of the input wave, and is therefore typically much narrower than the pulse width of the input wave.

Output from pulse conditioner may be provided to a trigger input of an analog timer 406A and to a reset input of timer 406B. Timers 406A-B may comprise paired NE555 timers, such as available in an NE556 package, or comparable analog timing devices. A low trigger input results in a high output (e.g., 5 V) from the timer device. A low reset input results in a low output (e.g., 0 V). The timing cycle is determined by astable or monostable timing circuits 408A, 408B, connected to the threshold inputs of timers 406A, 406B, respectively. More particularly, cycle times may be determined by a value of resistors R1, R2 and C1, C2 of the respective circuits 408A-B. Various suitable timing circuits are known in the art, and one of ordinary skill may readily configure a timing circuit to provide the desired cycle time.

Circuit 408A should be configured to provide a shorter cycle time than circuit 408B. An output of timer 408B may be connected to a power control module 410. Module 410 provides power to blower 412 of smoke generator 414 from power supply 416, in response to the control signal from timer 408B. Hence, blower 412 will operate for a period of time—herein referred to as the "on-chuff" time—determined by the timing circuit 408B. The on-chuff time is constant for a particular configuration of circuit 400, and should correspond to a scaled on-chuff time for the modeled steam engine. The period between chuffs, when the blower is off, is referred to herein as the "off-chuff" time. It should be apparent that as the frequency of the incoming pulses from chuff sensor 402 increases with increasing train speed, the off-chuff time will decrease while the on-chuff time will remain constant. Thus, the on-chuff pulses will be separated by off-chuff periods of decreasing duration, until the blower remains constantly on once the train is going sufficiently fast.

Circuit 408A should also be configured to provide a longer cycle time than the differentiated pulse width from the pulse conditioner 404. Timer 406A starts a timed interval (output pulse) when timer 406B is in a reset state. The output pulse from 406A is inverted by inverter 418 and provided to the trigger input of timer 406B. As long as the inverter output is low, it triggers an output pulse from timer 406B as soon as timer 406B returns to a "not reset" state. When pulses from pulse conditioner 404 arrive at shorter intervals than the timing interval of timer 406B, blower 412 will remain on continuously. When the output from inverter 418 goes high, which occurs when the pulse from timer 406A expires, the output from timer 406B is not affected. Arrival of the next reset pulse starts the cycle anew.

Power supply 416 may comprise any suitable analog power supply for providing a stable DC voltage, such as +5 V or other suitable voltage, for components of circuit 400. Switch 410 may comprise or be operably associated with components, such as a reverse recovery diode or a capacitor, for collapsing the flux field of blower 412 when the output to switch 410 goes low, as known in the art. Heater 420 may be controlled via a simple on/off switch, or more preferably, using a method of power control as disclosed herein. Control of heater 420 may be accomplished independently of blower control.

Figure 8:
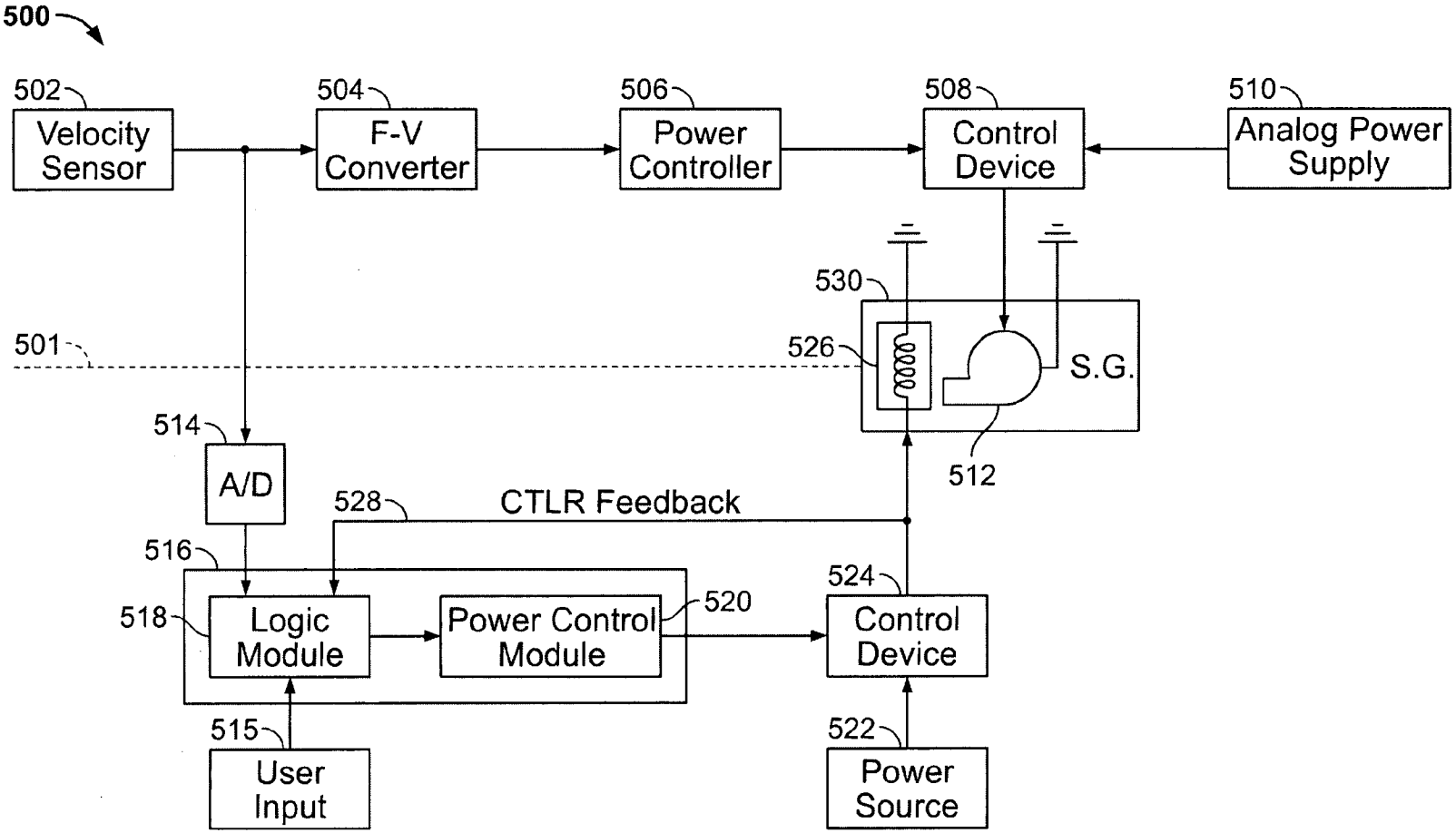
FIG. 8 is a block diagram for an analog control circuit for fan control to simulate a diesel engine.

FIG. 8 is a block diagram showing a method 500 for blower and heater control in a smoke generator, suitable for a model diesel engine. Control of the blower motor 412 is diagrammed above the dotted line 501 to indicate that blower control is performed separately from heater control. Velocity sensor 502 comprises any suitable velocity sensor. Traditional analog sensors, such as microswitch or Hall Effect sensor, may be suitable for providing a velocity signal to analog components of system 500. Digital encoders or other digital sensors may also be used. In the alternative, or in addition, an intelligent motor controller, for example, a Lionel DCDRS motor controller, may be configured to output a velocity signal that correlates to motor speed or load. In FIG. 8, sensor 502 comprises any suitable sensor providing a pulse output. The frequency of the output pulses from sensor 502 may correlate to train speed or motor load.

Frequency-voltage converter 504 may comprise any suitable device for providing a voltage output that correlates to a frequency input. For example, an analog integrating circuit as known in the art may be suitable. Less preferably, a digital converter may be used. In an embodiment of the invention, a National Semiconductor LM2907M-8 frequency-to-voltage converting device may be used. Output from the frequency converter may be provided to an analog power controller 506. Various analog controllers, such as pulse-width modulators or voltage control oscillators, are known in the art and may readily be constructed by one of ordinary skill in the electronic arts. Such controllers provide an output control signal having an integrated value proportional to the input control voltage. For example, PWM control circuits based on a NE555 analog timer are known in the art, and may be suitable. An output signal from the power controller 506 may be provided to a control device 508, which switches power from analog power supply 510 to blower 512 of smoke generator 530 in response to the control signal. Control device 508 may comprise any suitable switching device, for example, a triac, MOSFET device, transistor, or thyristor. The speed of the blower will thereby vary in proportion to the velocity control signal from the velocity sensor 502, simulating a diesel engine output.

To better simulate visible emissions from a diesel locomotive, fan speed may be a function of multiple variables, for example, two or more variable selected from train speed, motor speed, commanded motor speed, motor load, past or last engine state, and time since last change in engine state. For example, actual diesel locomotives "rev up" when first beginning to move, and therefore emit at a higher rate. System 500 may be configured to simulate this characteristic by using an intelligent motor controller or other controller to emulate an analog velocity input from sensor 502. In the alternative, any other suitable form of control signal may be used.

For example, an intelligent motor controller as known in the art for model vehicles, comprising a processor in association with a programmable memory, may be configured to provide an output control signal based on a difference between a commanded motor speed and the last motor velocity. The greater this difference, the more the model locomotive should rev-up to accomplish the required momentum change. To illustrate, when the model locomotive is starting from a standstill, the intelligent motor controller may provide a high velocity signal to the analog control element 504, thereby causing the fan 512 to operate at a correspondingly high speed. As the model locomotive begins to increase its velocity to the commanded velocity, or after a period of time, the velocity signal may be reduced, thereby lowering the fan speed. Similarly, an intelligent motor controller may vary the velocity signal in proportion to engine load, for example, to increase fan output when the engine is heavily loaded.

Smoke density may be controlled separately by controlling power to heater 526 using a separate control loop, which may be either digital or analog. In the depicted embodiment, a digital control loop is shown. Output from the velocity sensor 502 may be provided to any suitable processor 516 via an analog-to-digital converter 514. In the alternative, a separate velocity sensor may be used. Controller 516 may comprise any suitable controller, for example, a programmable logic controller and any auxiliary devices. In an embodiment of the invention, a radio control board, such as a R2LC board from Lionel, L.L.C. may be used. Controller 516 may comprise various control modules implemented in software, hardware, or some combination of software and hardware, such as logic module 518 and power control module 520.

Logic module 518 may be configured to receive a signal corresponding to velocity and determine a desired control set point based on a defined function relating train speed and heater power, as described hereinabove. The logic module may receive other input, such as from a user input device 515, which may be used as a variable or factor in this speed/power function. Logic module may further incorporate a process for controlling output power relative to the control set point and a feedback 528, such as using a closed-loop PID control method. In the alternative, a different control algorithm may be applied, or the heater control may be run open loop. Logic module 518 provides a signal to power control module 520 indicative of a desired power level.

Power control module 520 may be incorporated into controller 520, or may comprise a separate device. It may comprise an analog controller like controller 506, or a functionally equivalent digital device or module. A suitable control signal is provided to a control device 524, which switches power from power source 522 to heater 526 in response to the control signal from the power control module 520. Control device 524 may comprise any electronic switch like device 508, suitably configured for controlling power from source 522 to heater 526. Power source 522 may comprise any suitable source for heater 526, for example, AC or DC track power, or power from power supply 510 or any other suitable source.

Figure 9:
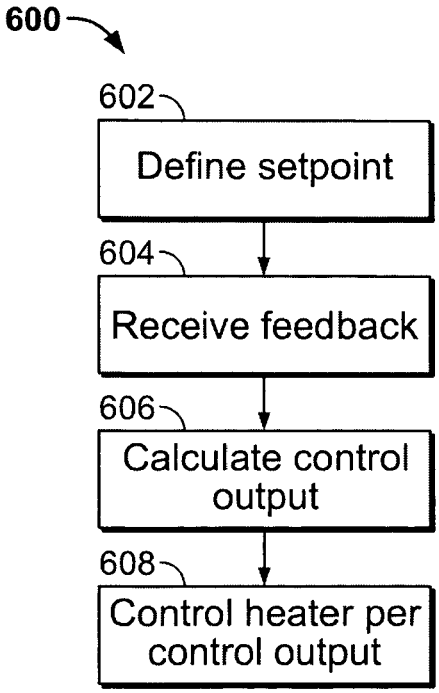
FIG. 9 is a flow diagram illustrating exemplary steps performed by a smoke generating unit according to an embodiment of the invention.

FIG. 9 illustrates exemplary steps of a method 600 for operating a smoke generating unit according to the invention. At step 602, a set point is defined using the system controller, based on static or variable manual user input, variable control input indicating engine load, vehicle velocity or other parameters related to smoke output, or some combination of the foregoing. The set point may correlate to a specific temperature of the smoke generator unit, or to a specific power to be provided to the heater, depending on the available control system. Step 602 may be performed at the initiation of method 600, and at periodic intervals thereafter. In the alternative, step 602 may be performed whenever an interrupt signal is received indicating a change in system parameters, or using any other desired trigger. Although the set point may be determined once and held constant thereafter, it is believed desirable to vary the set point in response to input parameters, so as to achieve a desired control over variable smoke output. An absolute maximum temperature threshold or power threshold may be predetermined and held constant, as an upper limit on possible set points that may be defined by the system controller.

At step 604, feedback indicative of smoke generator temperature or heater power is received by a processing module. The processing module may be implemented in hardware or software. As previously described, in an embodiment of the invention the sensor input should be derived from any suitable sensor operable to sense a control temperature of the smoke generating unit. This control temperature may be measured at a location depending on the design of the unit, and may include, for example, a temperature of a heating element, a fuel temperature, or a temperature in an interior smoke chamber. In the alternative, a signal indicative of power supplied to the heater may be provided. If desired, multiple sensor inputs may be received and used in some combination.

At step 606, a control output is calculated using any suitable feedback control scheme. In an embodiment employing a temperature sensor, input temperature may be the variable being controlled, and power supplied to a heater of the smoke generating unit may comprise a control output variable. In this embodiment, the calculation should determine the appropriate output power to the heater of the smoke generating unit, to drive the unit temperature, as determined from the sensor input, towards the current temperature set point. Various control schemes suitable are known in the art of process control, as have been described herein. In the alternative, in a system employing feedback control without a temperature sensor, power received by the heater may be used as the control variable. A correlation between output power and temperature or smoke output is assumed to comply with the characteristic of the smoke generator under operation. Such a system may also be run open loop.

At step 608, the control output is applied to control power supplied to the heater. Suitable methods to control power to a device based on a logical input are known in the art, and described herein. Application of method 600 by a continuous cycling of steps 602-608 should control the smoke generator to a variety of desired temperature or power set points corresponding to different rates of smoke output, thereby simulating smoke output in a model vehicle.

Figure 10:
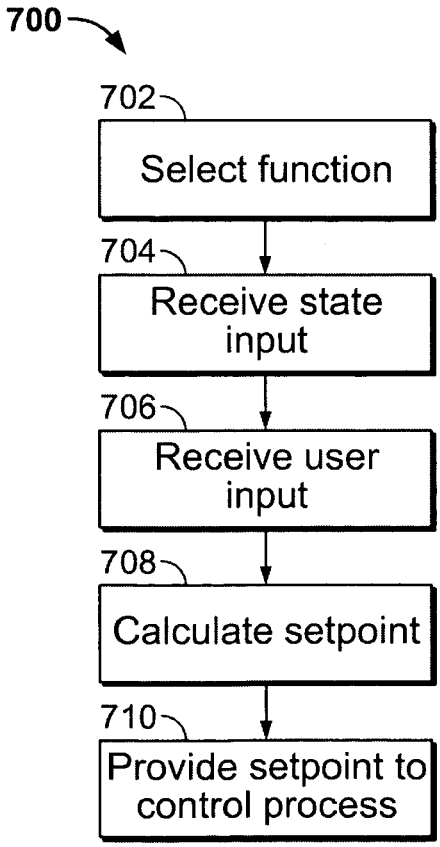
FIG. 10 is a flow diagram illustrating exemplary steps for defining a heater set point according to an embodiment of the invention.

FIG. 10 shows exemplary steps of a process 700 for defining a temperature or power set point for use in a control process such as method 600. Advantageously, method 700 permits smoke density to be controlled relative to train speed or engine load according to any desired function. It should therefore be possible, by selection of a suitable function relating smoke density to train speed, engine load, or some combination of the foregoing, to closely simulate steam or smoke output from an actual locomotive engine under various different conditions of speed and load. Different actual engines may exhibit different characteristic smoke or steam emission patterns. For example, some engines may emit the most smoke at low speeds and high loads, while for others more smoke may be emitted as high speeds regardless of load. Some may emit a burst of smoke when first powering up from idle, powering down, or when engine load changes rapidly. In addition, the rate of change in smoke output may vary between different models. It should now be possible to accurately reproduce these patterns at an appropriate scale in a model train. In addition, or in the alternative, user input may be used to scale output in any desired amount, up or down, while still preserving an underlying functional relationship between train state and smoke output. Method 700 may be performed using any suitable system as described herein for heater control.

Method 700 may also be adapted for control of fan speed in proportion to any of the aforementioned parameters, for example, vehicle velocity, engine speed, or engine load.

At step 702, a relationship between smoke output or fan speed and train variables such as velocity, load, or some combination of these or other variables is defined. In some cases, the desired function is loaded as a part of program instructions for a particular model of train, and is not changed. In other cases, different programs may be selected based on user input or other control variables, and loaded into memory as needed. For example, a user may select between a linear function and a non-linear function, or between different linear functions. For further example, a user may toggle between an automatic mode that calculates a varying smoke output or fan speed depending on engine conditions, and a manual mode, which sets the current smoke output or fan speed at a level determined solely from user input. Suitable functions may include, for example, a linear function, exponential function, quadratic function, logarithmic function, differential function, step function, bell curve, "post office" or other well-rounded linear function, or tabular look-up function, based on any number of input variables.

At step 704, state input regarding train or engine state is received. In many model trains, velocity as determined from wheel rotation is a readily available measure that correlates to engine conditions. Engine load input may also be gathered using voltage or current sensors. Such input may be differentiated, integrated, or otherwise processed to provide further input variables. The use of speed or load input does not preclude other variables that might bear on smoke output, for example, engine temperature. But for most cases, speed, load, or some combination of these inputs should be sufficient.

At step 706, user input may be received. For example, a user may select a desired relative level of smoke output, such as high, medium, or low, using a control panel. The desired relative smoke output may be applied as a scale factor or offset in an engine/smoke function. Or the user may specify an absolute level of smoke output, regardless of engine state. Yet another alternative is to receive user input selecting from between different functions or parameters.

At step 708, a controller uses the gathered inputs and selected control function to determine a set point for smoke generator temperature, heater power, or fan speed. This may be accomplished in software, for example, by setting function variables equal to control inputs and executing a function on the variables from program memory, or looking up an output in a lookup table, to determine an output value. A similar process may be performed in an analog circuit using hardware to provide a control output. The form of the control output should be defined so as to be useful for downstream control, with or without further signal processing. At step 710, the control output of method 700 may be provided to a cooperative control program or module for use in controlling the temperature, heater power or fan of the smoke generator.

Having thus described a preferred embodiment of a method and system for controlling a smoke generator for a model vehicle, it should be apparent to those skilled in the art that certain advantages of the within system have been achieved. It should also be appreciated that various modifications, adaptations, and alternative embodiments thereof may be made within the scope and spirit of the present invention. For example, an model train has been illustrated, but it should be apparent that the inventive concepts described above would be equally applicable to other model vehicles, e.g., boats, trucks, tractors, or the like. The invention is solely defined by the following claims.

What is claimed is:

1. A smoke or visible vapor generator for a model vehicle, comprising:

a controller;

a heater in electrical communication with the controller via a power control module;

a sensor disposed to provide input information to the controller, wherein the controller is configured to provide a control signal to the power control module responsive to the input information, the control signal configured for controlling power to the heater within a range operable to control an amount of visible emissions from fuel heated by the heater; and a feedback input to the controller, wherein the feedback is from a circuit element responsive to a condition selected from power supplied to the heater, heat output from the heater, and temperature, and wherein the controller is further configured to provide the control signal responsive to the feedback input.

2. The smoke or visible vapor generator of claim 1, wherein the controller executes a function for determining the control signal responsive to the input information selected from a linear function, a non-linear function, a quadratic function, an exponential function, a step function, a post-office function, a differential function, and any combination of the foregoing functions.

3. The smoke or visible vapor generator of claim 2, wherein the function is determined using a look-up table contained in a memory operably associated with the controller.

4. The smoke or visible vapor generator of claim 2, further comprising a user interface operably connected to the controller, and wherein the input information further comprises user input received from the user interface.

5. The smoke or visible vapor generator of claim 4, wherein the user input is operative to modify the function by an operation selected from: multiplying by a scale factor, dividing by a scale factor, adding an offset amount, subtracting an offset amount and some combination of the foregoing operations.

6. The smoke or visible vapor generator of claim 1, wherein the sensor is configured to provide the input information corresponding to a velocity of the model vehicle to the controller.

7. The smoke or visible vapor generator of claim 1, wherein the sensor comprises a sensor selected from a switch, a mechanical switch, an encoder and a Hall Effect sensor.

8. The smoke or visible vapor generator of claim 1, wherein the sensor is configured to provide the input information corresponding to an engine load of the model vehicle to the controller.

9. The smoke or visible vapor generator of claim 1, wherein the control signal is configured to define a set point selected from a voltage set point, a power set point, and a temperature set point.

10. The smoke or visible vapor generator of claim 1, wherein the feedback input comprises a signal indicating a voltage supplied to the heater.

11. The smoke or visible vapor generator of claim 1, wherein the feedback input comprises a signal indicating an amount of power supplied to the heater.

12. The smoke or visible vapor generator of claim 1, wherein the feedback input comprises a signal indicating a temperature of the generator.

13. The smoke or visible vapor generator of claim 1, wherein the controller is further configured to determine the control signal using the feedback input and a control scheme selected from proportional control, proportional-integral control, and proportional-integral-derivative control.

14. The smoke or visible vapor generator of claim 1, wherein the circuit element providing the feedback input comprises a temperature sensor disposed for sensing a temperature of the smoke generator, the temperature sensor in electrical communication with the controller.

15. The smoke or visible vapor generator of claim 14, wherein the temperature sensor comprises a sensor selected from a J-type thermocouple, a K-type thermocouple, and a thermistor.

16. The smoke or visible vapor generator of claim 14, wherein the controller is configured for receiving temperature sensor input from the temperature sensor, and configuring the control signal so as to cause the temperature sensor input to be driven towards a temperature set point.

17. The smoke or visible vapor generator of claim 1, wherein the controller comprises a processor operably associated with a memory, the memory holding program instructions configuring operation of the controller.

18. The smoke or visible vapor generator of claim 1, further comprising a blower disposed in fluid communication with the heater.

19. The smoke or visible vapor generator of claim 18, further comprising a blower control circuit for controlling an amount of power output to the blower as a function of at least one control input.

20. The smoke or visible vapor generator of claim 19, wherein the at least one control input is selected from an input indicating an engine load of a model vehicle bearing the smoke generator, and an input indicating a speed of the model vehicle.

21. The smoke or visible vapor generator of claim 19, wherein the blower control circuit is configured for controlling an amount of power output to the blower so as to cause smoke to be emitted in puffs.

22. The smoke or visible vapor generator of claim 19, wherein the blower control circuit comprises an analog control circuit receiving the control output and controlling the blower separately from the controller.

23. The smoke or visible vapor generator of claim 22, wherein the analog control circuit comprises a plurality of analog timers coupled to provide an output pulse for puffing the blower at a rate proportional to the speed of the model vehicle.

24. The smoke or visible vapor generator of claim 1, wherein the heater includes a resistive heating element having terminals disposed at its opposite ends, each terminal operable for connecting the element to the smoke generating unit.

25. A method for generating visible emissions for a model vehicle, the method comprising the steps of:

calculating a control output for an emission generating unit of a model vehicle in response to a current model vehicle state, wherein the control output indicates an amount of power to be supplied to a heater of the emission generating unit; and controlling an amount of power output to the heater based on the control output, so as to cause the emission generating unit to emit visible emissions at a desired emission rate;

wherein the calculating step further comprises calculating the control output based a feedback input indicating information selected from a voltage supplied to the heater, an amount of power supplied to the heater, and a temperature of the emission generating unit.

26. The method of claim 25, further comprising receiving at least one input indicating the current model vehicle state.

27. The method of claim 25, wherein the calculating step further comprises calculating the control output using a function defining a relationship between the model vehicle state and control outputs over an operating range.

28. The method of claim 25, wherein the calculating step further comprises calculating the control output based on the current model vehicle state selected from a velocity of the model vehicle and an engine load of the model vehicle.

29. The method of claim 25, further comprising receiving user input from a user interface device.

30. The method of claim 29, wherein the calculating step further comprises calculating the control output based on the user input.

31. The method of claim 25, wherein the calculating step further comprises calculating the control output configured to define a set point selected from a voltage set point, a power set point, and a temperature set point.

32. A smoke or visible vapor generator for a model vehicle, comprising:

a controller;

a heater in electrical communication with the controller and adapted to heat a fuel material;

a blower operatively coupled in fluid communication with the heater;

a blower control circuit operatively coupled to the blower for controlling an amount of power provided to the blower as a function of at least one control input; and a feedback input to the controller, wherein the feedback is from a circuit element responsive to a condition selected from power supplied to the heater, heat output from the heater, and temperature;

wherein the at least one control input is a function of at least one parameter selected from vehicle velocity, engine speed, engine load, last engine state, commanded engine state, and time since last engine state change.

33. The smoke or visible vapor generator of claim 32, wherein the controller is operatively associated with the blower control circuit and executes a function for determining the control input selected from a linear function, a non-linear function, a quadratic function, an exponential function, a step function, a post-office function, a differential function, and any combination of the foregoing functions.

34. The smoke or visible vapor generator of claim 32, wherein the at least one parameter is selected from a first parameter indicating an engine load of a model vehicle bearing the smoke generator, and a second parameter indicating a speed of the model vehicle.

35. The smoke or visible vapor generator of claim 32, wherein the controller is operatively associated with the blower control circuit and is configured for providing the at least one control input so as to cause the blower to operate at a speed proportional to vehicle velocity.

36. The smoke or visible vapor generator of claim 32, wherein the controller is operatively associated with the blower control circuit and is configured for providing the at least one control input so as to cause the blower to operate at a speed proportional to vehicle load.

37. The smoke or visible vapor generator of claim 32, wherein the controller is operatively associated with the blower control circuit and is configured for providing the at least one control input so as to cause the blower to operate at a speed determined by a commanded change in vehicle motion.

38. The smoke or visible vapor generator of claim 32, wherein the blower control circuit comprises an analog control circuit receiving the at least one control input as a pulsed input.

* * * * *